United States Patent [19]

Geiger

[11] Patent Number: 4,551,080

[45] Date of Patent: Nov. 5, 1985

[54] VARIABLE DISPLACEMENT SLIDING VANE PUMP/HYDRAULIC MOTOR

[76] Inventor: Cletus M. Geiger, 3 E. High St., Bound Brook, N.J. 08805

[21] Appl. No.: 543,465

[22] Filed: Oct. 19, 1983

[51] Int. Cl.[4] ..... F04C 15/04

[52] U.S. Cl. ..... 418/28; 418/267

[58] Field of Search ..... 418/21, 23, 24, 28, 418/267, 29

[56] References Cited

U.S. PATENT DOCUMENTS

| | | | |
|---|---|---|---|
| 1,527,685 | 2/1925 | Huwiler | 418/28 |
| 1,797,905 | 3/1931 | Dooley | 418/28 |
| 2,330,565 | 9/1943 | Eckart | 418/28 |
| 2,581,160 | 1/1952 | Adams | 418/28 |
| 2,925,785 | 2/1960 | Sander | 418/28 |
| 4,046,493 | 9/1977 | Alund | 418/28 |

*Primary Examiner*—Leonard E. Smith
*Assistant Examiner*—Jane E. Obee
*Attorney, Agent, or Firm*—Robert J. Ferb

[57] ABSTRACT

This invention, a variable displacement sliding vane pump/hydraulic motor, incorporates an eccentric chamber in which a rotor with a plurality of axially and radially moveable sliding vanes rotates. Axial positioning of the sliding vanes is accomplished by positioning a sliding wall; the swept volume and therefore the capacity of this invention is also directly related to the positioning of the sliding wall. This sliding wall can be positioned by external means including conventional manual and automatic devices. Various embodiments permit pumping capacity variability from essentially zero flow to full flow without the use of bypasses.

9 Claims, 9 Drawing Figures

VARIABLE DISPLACEMENT SLIDING VANE PUMP/HYDRAULIC MOTOR

BACKGROUND OF INVENTION

There are many uses for pumps and hydraulic motors which are capable of variable flow and pressure operation. These types of devices are widely used in industrial, commerical and consumer applications where, in a typical application, a fixed speed electric motor drives a pump and fluid discharged from the pump drives a hydraulic motor at some other location. Variable speed or load demands at the hydraulic motor are accommodated by various means. In some instances a variable speed drive such as a variable voltage D.C. motor or a variable frequency A.C. drive motor or a fixed speed motor with a belt type variable pulley drive or an internal combustion engine are used to vary the speed of the pump. When the pump speed is varied the volume of fluid transmitted to the hydraulic motor is varied to accommodate the load conditions. In addition to these methods, other methods such as bypassing part of the output of the pump, especially if the pump is coupled directly to fixed speed drive motor, are frequently used.

All of these methods of providing for variable loads in pump/hydraulic motor drive systems require either a variable speed primary driver or an efficient means of achieving fluid bypassing. In addition, where a variable speed primary driver is used especially in the case of internal combustion engines, such as in automotive use, where the engine is coupled to an automatic transmission, the primary driver is rarely operated at or near the point of optimum efficiency due to the speed and load variations encountered.

An efficient, reliable and relatively simple variable displacement pump/hydraulic motor could be used to advantage in any of the instances cited above. More economical fixed speed primary drivers could be used with such a device to efficiently accommodate normal load variations. In addition, such a device would permit internal combustion engine driven systems to operate at peak engine efficiency for nearly all speeds and load conditions.

The enhanced efficiency available when engine operation can be separated from speed requirements can be achieved with a variable displacement pump/hydraulic motor if it is capable of permitting a wide but continuous range of fluid pumping rates over a broad range of fluid pressure to achieve the equivalent of a continuously variable transmission. A range of ratios of 12 to 1 is suggested by the literature. (A Continuously Variable Transmission for Automotive Fuel Economy by J. H. Kraus, C. E. Kraus and M. E. Gres, Excelermatic, Inc. S.A.E. 751180. 3307 to 3316).

There have been a number of prior inventions in the field of variable displacement sliding vane pumps/hydraulic motors. These prior inventions have certain limitations which somewhat limit their utility. A typical example of the limitations present in the prior art can be found in U.S. Pat. No. 4,046,493, Sliding Vane Machine invented by Torsten Olund. This invention described a machine in which the vanes(5) in the pump must be compressed abruptly into their grooves(4) during rotation of the rotor(3) to bypass partition walls(6) separating pressure chambers within the pump housing.

Other variable displacement sliding vane pumps/hydraulic motors such as the one illustrated in S.A.E. paper 790725 entitled "A New Automatic Transmission for Improved Fuel Economy—General Motors THM 125" presented by Erkki A. Koivunen and Philip A. Lebar, Jr., Hydramatic Division of General Motors Corporation, June, 1979, incorporates an eccentric rotor and vane assembly contained in a slide housing which is mounted on a pivot to enable the eccentricity of the rotor assembly and therefore the pumping capacity to be varied. This pump, however, is used only to replace the conventional pump in the transmission and the usual clutch/gear sets are used to achieve the necessary gear reductions.

The present invention, a variable displacement sliding vane pump/hydraulic motor, can be used both as a pump and as a hydraulic motor. It incorporates the capability of virtually unlimited variability from zero flow to maximum pumping capacity. This capability is achieved without the use of internal partitions.

SUMMARY OF THE INVENTION

The following is a description of the instant invention which comprises a variable displacement sliding vane pump.

While the primary purpose that is presently contemplated for the use of this pump is power transmission, such as automotive use in place of conventional transmissions, many other uses are also possible.

The main elements of the invention are comprised of:

A housing or casing in which a rotor assembly is mounted on a shaft. This rotor assembly has a hub portion which is also cylindrical and is centered on the shaft and essentially fills the inside of the pump housing. The rotor assembly has a series of radial slots into which sliding vanes are fitted. These slots permit radial as well as lateral movement of the vanes relative to the shaft. These slots extend from the hub portion of the rotor assembly to a rotor portion of the rotor assembly which is smaller in diameter than the hub portion of the rotor assembly.

The housing or casing has two internal chambers. The first is shaped to accept the hub portion of the rotor assembly and is concentric with the hub portion with a slightly larger diameter to permit the hub to rotate inside the housing while minimizing fluid leakage between the hub and housing. A circular seal of conventional design may be used to further reduce fluid leakage between the hub and housing.

The second internal chamber is also cylindrical but it is not concentric with the rotor assembly. It is larger in diameter than the rotor portion of the rotor assembly and is off center or eccentric to the rotor assembly shaft. This offset is selected to produce close clearance on one side of the rotor between the rotor and the pump casing and a wide clearance on the opposite side of the rotor similar to the configuration found in conventional vane type pumps.

The shaft extends out of the housing to accept a primary driver such as a motor or connects to a device to be driven by this invention when this invention is being used as a driver itself.

Ports, with appropriate external connections, are also included to permit the fluid to be pumped to enter and to exit from the second internal chamber of the pump housing.

Sliding vanes are mounted in slots in the rotor assembly. These vanes are capable of radial movement as in conventional sliding vane pumps and in addition they are capable of moving in a lateral direction parallel to the shaft. This lateral movement occurs when the volume of the space between the rotor and the casing is reduced when the sliding wall is moved parallel to the shaft to increase or reduce the swept volume of the pump.

The sliding wall is slideably and rotatably mounted on the shaft and has a hollow portion shaped to surround the rotor portion of the rotor assembly. The outside diameter of this sliding wall essentially fills the inside diameter of the pump housing. The sliding wall is shaped to conform to the shape of the eccentric chamber portion of the housing and the rotor rotates within this portion of the sliding wall.

The hollow portion of the sliding wall slides over the portion of the rotor in which the vanes are mounted. This sliding wall can be positioned so that the portion of the rotor containing the sliding vanes is only partially inserted or is nearly completely inserted into this hollow portion of the sliding wall. This variation of insertion of the rotor portion of the rotor assembly into the sliding wall causes the sliding vanes to move laterally into the hub portion of the rotor assembly and reduces the swept volume of the pump.

Two additional elements are found to be especially advantageous when incorporated into the present invention, especially when maximum variability in pumping capacity is desirable.

These elements are a sliding vane support ring and a fluid pumping chamber partition.

The fluid pumping chamber partition is incorporated into the rotor assembly as an integral part thereof. It is located at the hub end of the rotor and it also incorporates radial slots to accommodate both lateral and radial movement of the sliding vanes. This partition is a circular disk perpendicular to the axis of the shaft and concentric with the rotor assembly. When the partition is incorporated into the rotor assembly a portion of the hub is cut away adjacent to the partition to a depth equal to the outside diameter of the rotor portion of the rotor assembly thereby forming a groove on the rotor assembly in the hub behind the partition. The sliding vane support ring fits into this groove. The sliding vane support ring has an inside diameter which is equal in diameter to the second or eccentric chamber in the housing and is concentric with this second eccentric chamber. The outside diameter of the sliding vane support ring is slightly smaller than that of the first or concentric internal chamber of the housing. The support ring is securely attached to the housing. The support ring is narrower than the groove and is positioned so that one face of the support ring is nearly touching the partition ring leaving a space between the support ring and the hub of the rotor assembly.

The partition and support ring permit the sliding vanes to be moved laterally by the sliding wall so that the sliding vanes are essentially flush with the face of the partition. At this point the swept volume of the pump is essentially zero and the pumping capacity is also essentially zero. The inside diametrical surface of the support ring provides a means to support the sliding vanes when they have been moved laterally towards the hub by the sliding wall to the point that they no longer are adequately supported by the inner surface of the eccentric chamber in the housing.

The partition and support ring permit the flow capacity of the pump to be varied from zero to the pump's maximum capacity by positioning the sliding wall so that the sliding vanes are either fully inserted through the partition or fully extended into the eccentric chamber.

The sliding wall can be positioned relative to the eccentric portion of the rotor by either hydraulic or mechanical means external to the pump to adjust the pump capacity. These adjustments of the position of the sliding wall can be made while the pump is operating.

The pump can also be operated at variable speeds to produce virtually unlimited variations of pressure and flow rate.

DETAILED DESCRIPTION OF THE INVENTION

Figure 1:
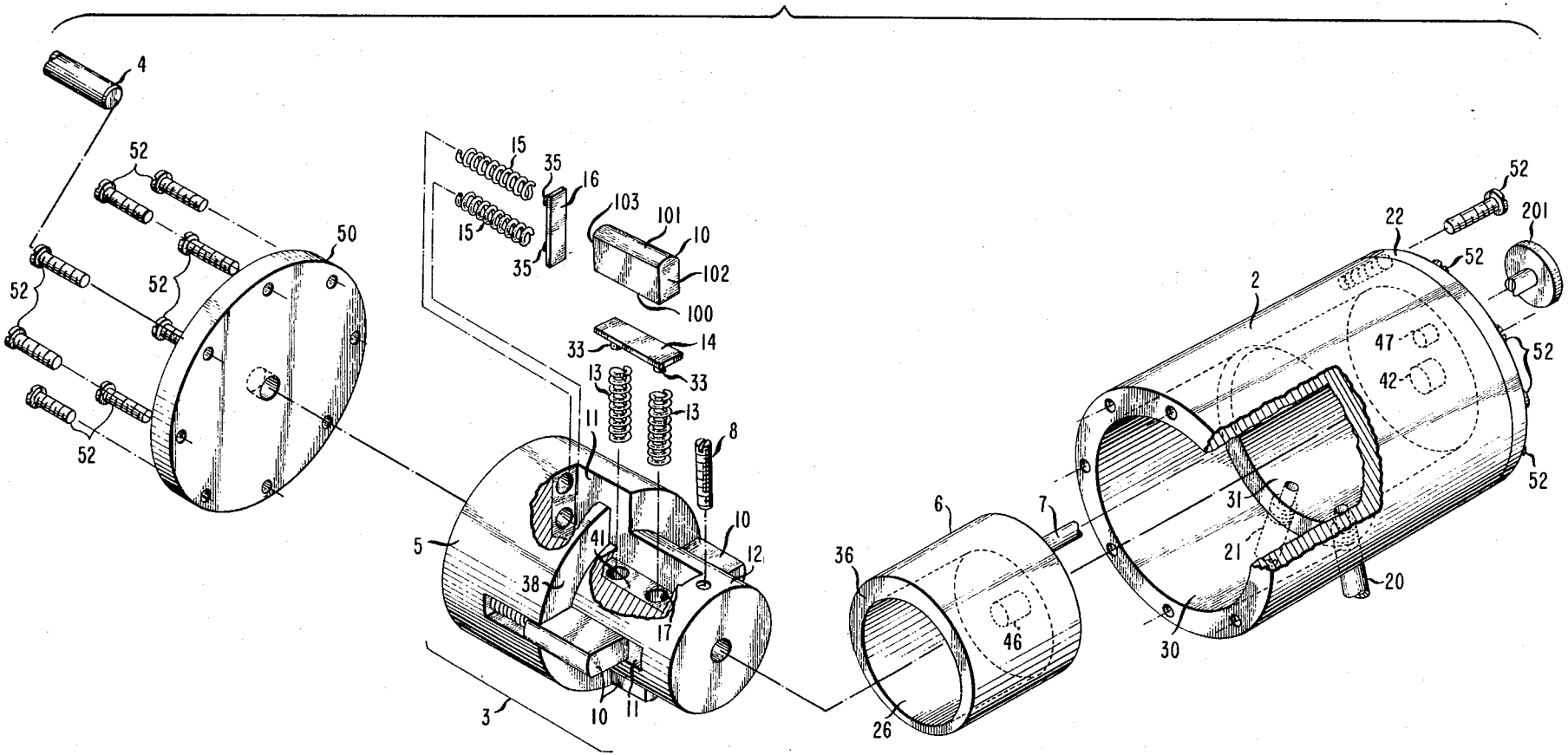
FIG. 1 shows an exploded view of the variable displacement sliding vane pump and illustrates all major components of the pump.

FIG. 1 shows an exploded view of the variable displacement sliding vane pump/hydraulic motor which is the subject of the invention described herein. For the sake of brevity this device will be referred to herein as the pump 1.

The pump 1 is comprised of the following major components: a housing 2 which is closed at one end by cover plate 22 which forms an eccentric chamber 31 adjacent to cover plate 22 and an internal chamber 30 which is in part contiguous with eccentric chamber 31 within housing 2. The axial length of internal chamber 30 is approximately the same length as the axial length of hub 5 and sufficient clearance is provided to permit hub 5 to rotate inside of internal chamber 30 when pump 1 is assembled. A fluid inlet port 20 permits fluid to enter eccentric chamber 31 through housing 2 and a fluid outlet port 21 provides a means for fluid to exit from eccentric chamber 31 through housing 2.

When pump 1 is assembled sliding wall 6 is inserted into eccentric chamber 31 of housing 2 so that positioner 7 passes through positioner opening 47 and shaft clearance hole 46 is concentric with shaft outlet 42. Positioner 7 is attached at one end to sliding wall 6 and at the other end to positioner mechanism 201 and serves a the link between positioner mechanism 201 and sliding wall 6.

Sliding wall 6: The outside diameter of sliding wall 6 is slightly smaller than the diameter of eccentric chamber 31. In addition the sliding wall has a cylindrical rotor chamber 26 which is concentric with shaft clearance hole 46 and slightly larger in diameter than rotor 12. The axial length of rotor 12 is approximately the same length as the axial depth of rotor chamber 26.

Rotor assembly 3 consists of hub 5 which is slightly smaller in diameter than internal chamber 30 and rotor 12 which has a plurality of radial slots 11 therein. At least one spring recess 17 is located in each radial slot's base 41 to position each radial tension spring 13. In addition at least one spring recess 17 is located in each radial slot edge 41 to position each lateral tension spring 13 by means of radial spring locating pin 33 which is attached to radial tension spring plate 14.

A lateral tension spring plate 16 engages each lateral tension spring 15 by means of lateral spring locating pin 35 which is attached to lateral tension spring plate 16. A sliding vane 10 rides in each radial slot 11 with its base 100 on the face of radial spring tension plate 14 and its foot 103 on the face of lateral spring tension plate 16.

When rotor assembly 3 is inserted into housing 2, rotor 12 is inserted into rotor chamber 26 in sliding wall 6. The head 102 of each sliding vane 10 rides on seal face 36 of sliding wall 6.

The outer face 101 of each sliding vane 10 rides on the inner surface of eccentric chamber 31 and is pressed outward by radial tension spring 13 to effect a seal along the outer face 101 of sliding vane 10.

When assembled, rotor assembly 3 is attached to shaft 4 by tightening set screw 8.

End plate 50 and cover plate 22 are secured to the ends of housing 2 by means of fastener 52 to enclose rotor assembly 3 and sliding wall 6. The assembled pump 1 is attached via shaft 4 through coupling 207 to primary drive motor 200 as illustrated in FIGS. 2 and 3.

THEORY OF OPERATION

Figure 2:
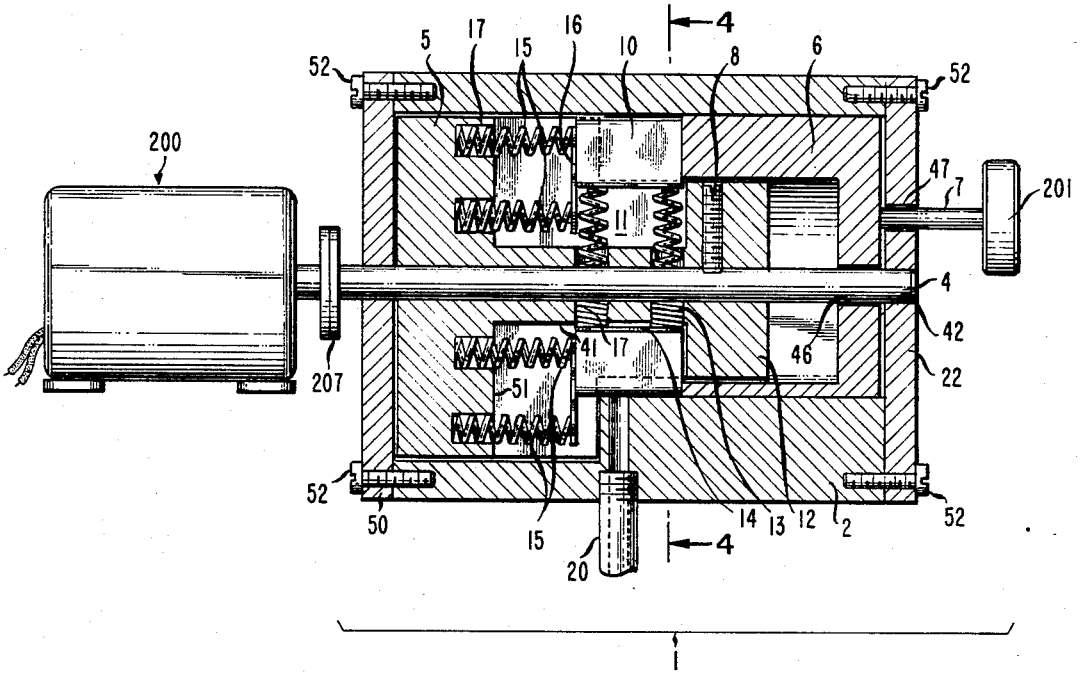
FIG. 2 shows the variable displacement sliding vane pump in cross section and illustrates the sliding wall and vanes in position for maximum pumping capacity.
Figure 3:
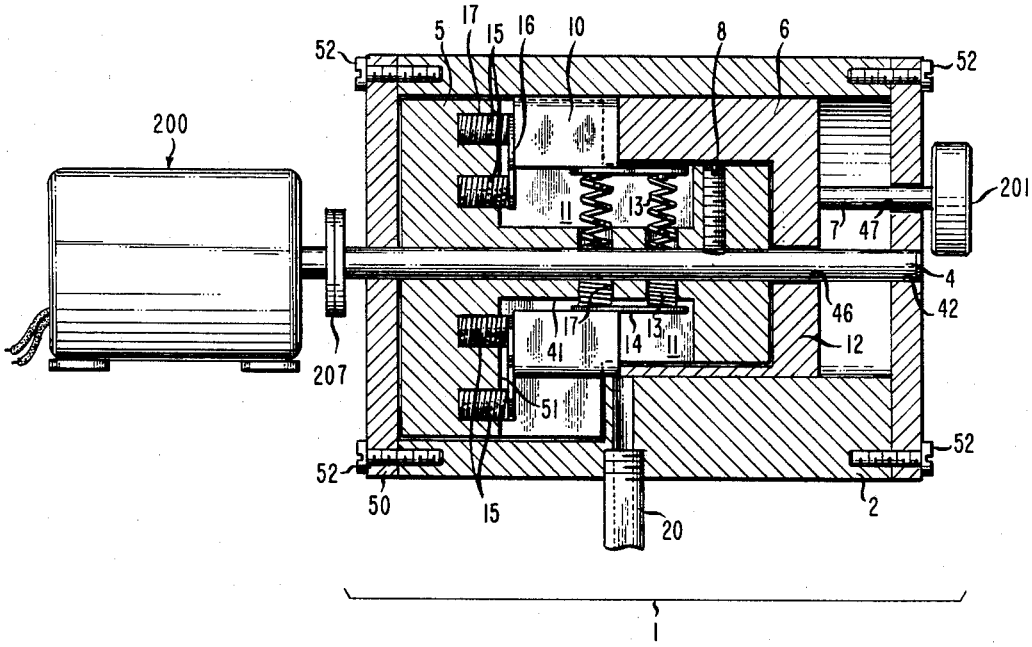
FIG. 3 shows the variable displacement sliding vane pump in cross section and illustrates the sliding wall and vanes in position for minimum pumping capacity.
Figure 4:
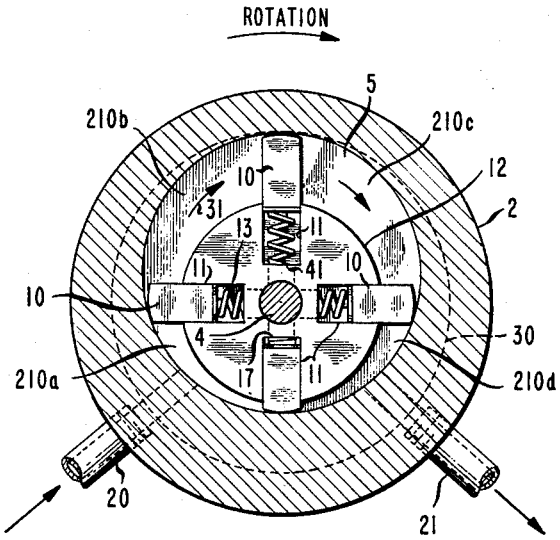
FIG. 4 shows a section view through plane 4—4 in FIG. 2 and illustrates the relative positions of the housing, rotor, and vanes.

FIG. 2 illustrates pump 1 with sliding wall 6 in the maximum flow position. To acheive this position of sliding wall 6, positioner mechanism 201 displaces positioner 7 to it's extreme right position, as shown in FIG. 2, thereby moving sliding wall 6 in close proximity to cover plate 22. In this position sliding vanes 10 extend to their maximum length from radial slots 11 in hub 5. Lateral tension springs 15 are at their maximum extension and sliding wall 6 is essentially flush against cover plate 22. In this position the cross sectional area swept by sliding vanes 10 inside eccentric chamber 31 is a maximum. Therefore when rotor assembly 3 is rotated by primary driver 200 via coupling 207 and shaft 4 a maximum amount of fluid is drawn into pump 1 through inlet fluid port 20 and expelled through outlet fluid port 21. The fluid flow path is illustrated in FIG. 4 which shows a cross section of FIG. 2 at 4—4 through housing 2 and rotor 12. A plurality of fluid chambers 210 are formed between successive sliding vanes 10, the cylindrical wall of eccentric chamber 31, the outer surface of rotor 12, seal face 36 of sliding wall 6 and hub face 38.

Fluid is drawn into fluid chamber 210*a* through inlet fluid port 20 as rotor assembly 3 rotates in a clockwise direction. This drawing of fluid into fluid chamber 210*a* continues until a sliding vanes 10 passes over inlet fluid port 20. This fluid is carried progressively in a clockwise direction through what appear as fluid chambers 210*b* and 210*c* in FIG. 4 and finally to fluid chamber 210*d* where the fluid is forced out of fluid chamber 210*d* through outlet fluid port 21 as sliding vane 10 is compressed radially inward into radial slot 11 as sliding vane 10 approaches outlet fluid port 21.

FIG. 3 illustrates pump 1 with sliding wall 6 in the minimum flow position. To acheive this position of sliding wall 6, positioner mechanism 201 displaces positioner 7 to it's extreme left position, as shown in FIG. 3, thereby moving sliding wall 6 to it's most distant point from cover plate 22. In this position sliding vanes 10 are extended their minimum length from radial slots 11 in hub 5. Lateral tension springs 15 are fully compressed and sliding wall 6 is essentially fully enveloping rotor 12. In this position the cross sectional area swept by sliding vanes 10 inside eccentric chamber 31 is a minimum. Therefore when rotor assembly 3 is rotated as stated above a minimum amount of fluid is drawn into pump 1 through inlet fluid port 20 and expelled through outlet fluid port 21. The flow of fluid through pump 1 is the same as that described above except that the volume of fluid pumped is diminished because only a small portion of sliding vanes 10 protrude from radial slots 11 past hub face 38 into eccentric chamber 31.

Radial motion of sliding vanes 10 in radial slots 11 in rotor assembly 3 occurs in the same manner as those in conventional sliding vane pumps or hydraulic motors which incorporate an eccentric pumping chamber.

The fluid flow rate passed through pump 1 at a given rate of rotor assembly 3 rotation is essentially directly proportional to the length that sliding vanes 10 protrude from radial slots 11 past hub face 38. Therefore the ratio between the maximum flow rate which can be achieved and the minimum flow rate is the ratio of the length of the maximum extension of sliding vanes 10 past hub face 38 to the length of the minimum extension of sliding vane 10 past hub face 38. A ratio of at least 12 is contemplated by this invention. Lesser ratios may also be desirable and are also contemplated by this invention.

An alternative embodiment of this invention includes two additional elements: sliding vane support ring 18 and partition 19. These additional elements are particularly useful when a very high ratio of maximum pumping capacity to minimum pumping capacity is desirable.

Figure 5:
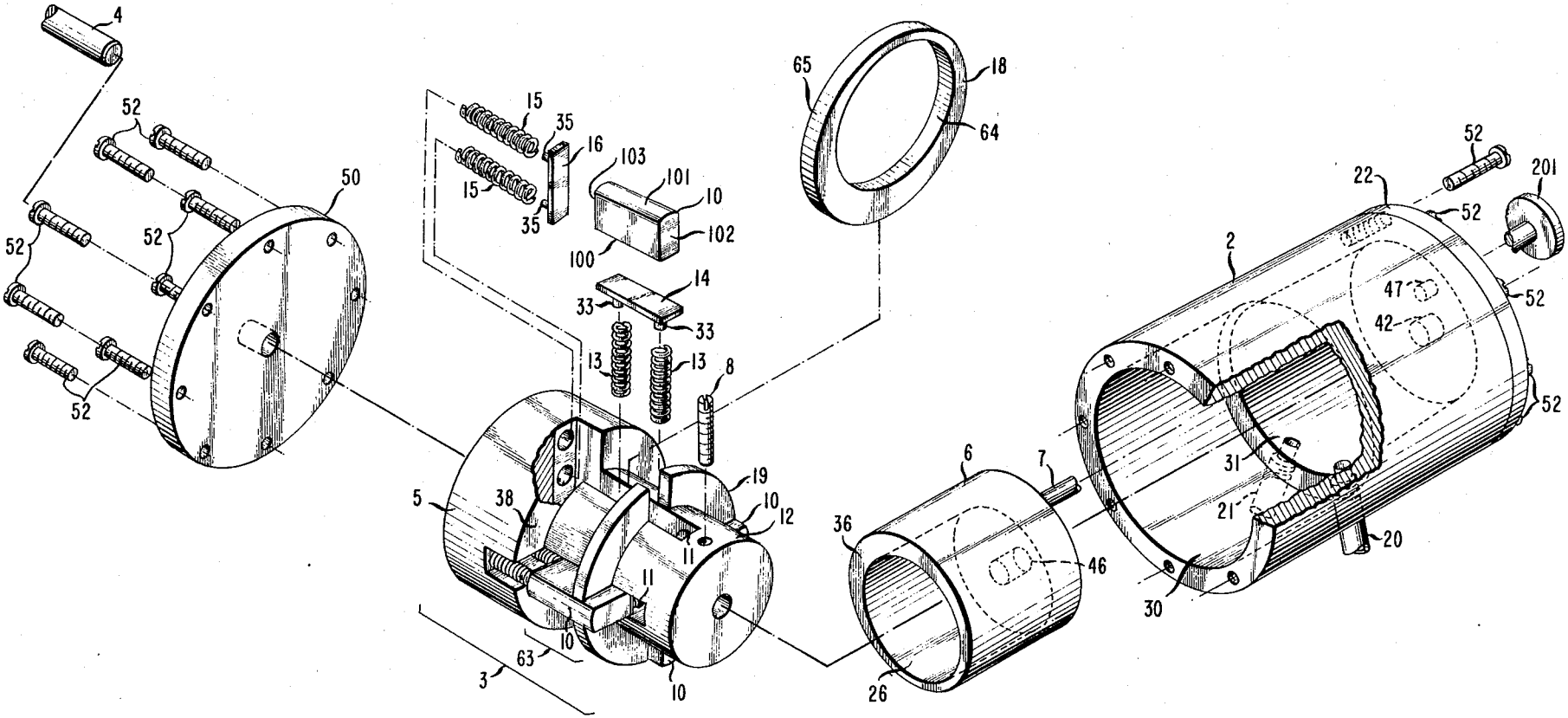
FIG. 5 shows an exploded view of an alternative embodiment of the variable displacement sliding vane pump in which the partition and sliding vane support ring are included.
Figure 6:
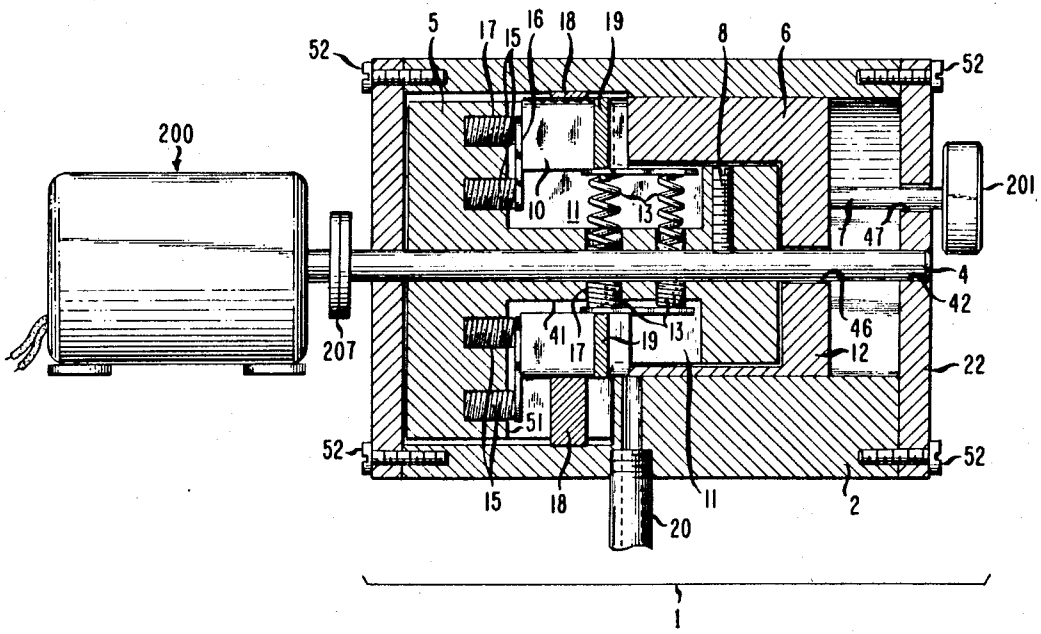
FIG. 6 shows the variable displacement sliding vane pump in cross section with the partition and sliding vane support ring and illustrates the sliding wall and vanes in position for minimum pumping capacity.

The location and function of support ring 18 and partition 19 are illustrated in FIG. 5 and FIG. 6.

FIG. 5 shows an exploded view of pump 1 with partition 19 attached to or made a part of rotor 12. When partition 19 is integrated onto rotor assembly 3, groove 63 is formed between partition 19, a portion of rotor 12 and hub face 38. Radial slots 11 in rotor assembly 3 also traverse partition 19 so that sliding vanes 10 can move both radially and laterally through partition 19. Support ring 18, when pump 1 is assembled, is located in groove 63 directly adjacent to partition 19. Groove 63 is wider than partition 18 in the axial dimension and when support ring 18 is in position adjacent to partition 19, bypass area 62, as shown in FIG. 6, is formed between support ring 18 and hub face 38. Bypass area 62 permits any fluid which has entered groove 63 from fluid chambers 210 to circulate in bypass area 62 when rotor assembly 3 is rotated within housing 2.

Support ring 18, when pump is assembled, is aligned within housing 2 so that inner surface 64 of support ring 18 is concentric with and equal in diameter to eccentric chamber 31. Support ring 18 is securely mounted to housing 2 in internal chamber 30 and outer surface 65 is concentric with internal chamber 30. The outside diameter of support ring 18 is essentially equal to the inside diameter of internal chamber 30.

In this embodiment, when sliding wall 6 is moved towards the minimum flow position, that is, when seal face 36 presses sliding vanes 10 towards hub 5, outer faces 101 of sliding vanes 10 begin to ride on inner surface 64 of support ring 18. Therefore for a portion of the lateral movement of sliding vanes 10, as they are moved laterally by sliding wall 6 from the maximum pumping position towards the minimum pumping position, outer faces 101 of sliding vanes 10 first ride on the surface of eccentric chamber 31. As sliding vanes 10 move close to hub face 38, outer faces 101 of sliding vanes 10 also begin to ride on inner surface 64 of support ring 18. As sliding wall 6 is moved laterally towards the minimum flow position and seal face 36 approaches very close to partition 19, outer face 101 of sliding vanes 10 are riding only on inner surface 64 of support ring 18 and are no longer in contact with the surface of eccentric chamber 31.

This embodiment of pump 1 permits the volume of fluid chamber 210 to be reduced to essentially zero while providing continuous support of sliding vanes 10 on outer surface 101, thereby permitting an essentially infinite ratio of maximum fluid flow to minimum fluid flow.

The position of sliding wall 6, as described above, is adjusted by means of positioner 7 which is motivated and positioned by positioner mechanism 201. This positioning of sliding wall 6 can be achieved by positioner mechanism 201 by using any conventional means including manual, pneumatic, hydraulic or any other means of positioning sliding wall 6 inside eccentric chamber 31. Positioner 7, the link between sliding wall 6 and positioner mechanism 201, can be a rod like device as shown in FIGS. 1,2,3,5 and 6 or any other conventional device which can be attached at one end to sliding wall 6 and at the other to positioner mechanism 201 to effect axial movement of sliding wall 6.

It is also understood that for the sake of clarity various conventional means of supporting and sealing the shafts and other rotating and nonrotating parts have not been illustrated.

It is also understood that this invention can also function as a hydraulic motor whereby pressurized fluid would be introduced into inlet fluid port 20 and the increased fluid pressure would cause rotor assembly 3 to rotate shaft 4. The fluid would be expelled via outlet fluid port 21 after traveling through fluid chambers 210.

It is also understood that pump 1 can be operated in counter clockwise rotation by reversing the fluid path through pump 1, namely by introducing pressurized fluid into outlet fluid port 21 and discharging it via inlet fluid port 20.

Figure 7:
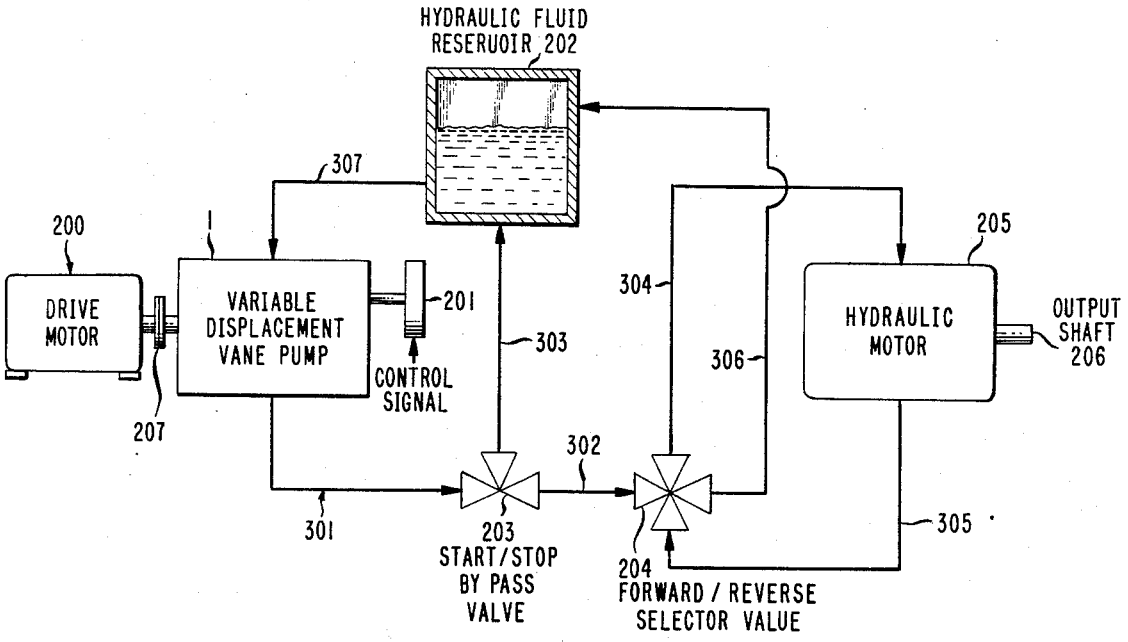
FIG. 7 shows schematically a flow sheet for a typical installation of the variable displacement sliding vane pump.

FIG. 7 is a schematic description of the within invention incorporated into a typical hydraulic variable speed drive assembly.

In this assembly primary drive motor 200 drives variable displacement vane pump 1 to provide fluid flow from hydraulic fluid reservoir 202 through line 307 into pump 1 where the fluid is pressurized and expelled into line 301. From line 301 fluid flows to start/stop bypass valve 203. This valve can be used to divert fluid from line 301 to hydraulic fluid reservoir 202 via line 303 if no output via output shaft 206 is required. When output is required, fluid is diverted into line 302 where it enters forward/reverse selector valve 204. Forward/reverse selector valve 204 can be used to direct fluid from line 302 into either line 304 or line 305. If fluid is directed into line 304 fluid enters hydraulic motor 205 and causes output shaft 206 to rotate in one direction. Fluid flows out of hydraulic motor 205 via line 305 to forward-/reverse selector valve 204 and is directed into line 306 through which the fluid is returned to hydraulic fluid reservoir 202. If fluid is directed into line 305 from forward/reverse selector valve 204, fluid enters hydraulic motor 205 via line 305 and shaft 206 rotates in a direction opposite to that stated above. Here fluid flows from hydraulic motor 205 via line 304 to forward-/reverse selector valve 204 via line 306 to hydraulic fluid reservoir 202.

If primary drive motor 200 is a constant speed motor the fluid flow from variable displacement pump 1 can be increased or decreased by imposing an appropriate control signal on positioner mechanism 201. Positioner mechanism 201 will relocate sliding wall 6 within pump 1, as described above, to vary the fluid flow rate from pump 1. Varying the fluid flow rate will result in a proportional variation in the rotational speed of output shaft 206.

Figure 8:
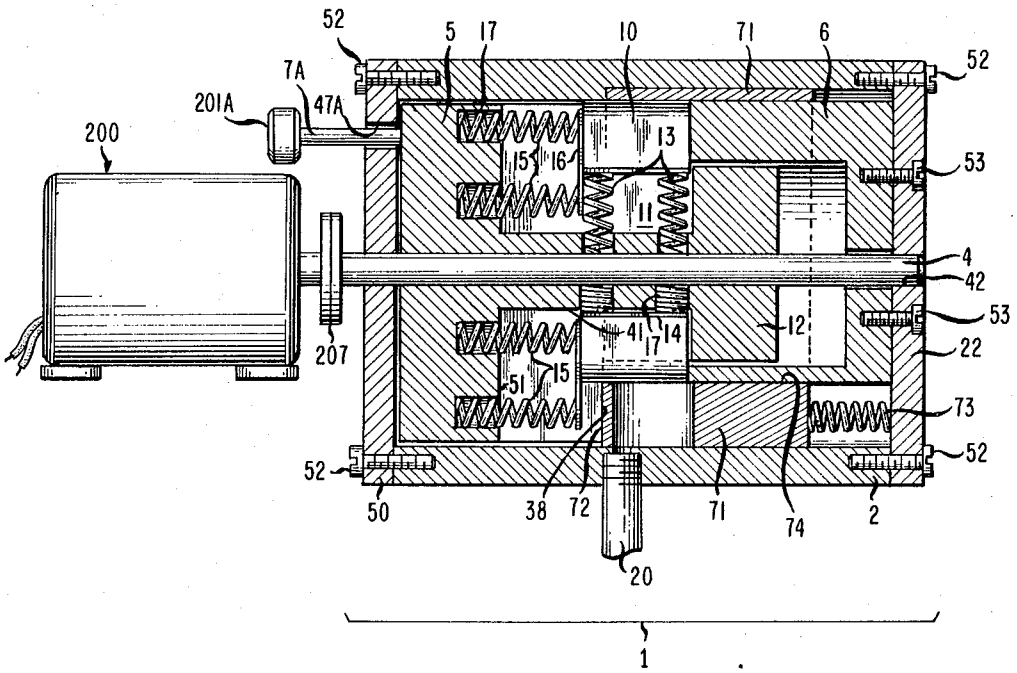
FIG. 8 shows an alternative embodiment of the variable displacement sliding vane pump wherein the rotor is moveable in the axial direction.

FIG. 8 shows an alternative embodiment of the variable displacement sliding vane pump. In this embodiment sliding wall 6 is securely mounted on cover plate 22 and rotor assembly 3 is mounted on shaft 4 so that rotor assembly 3 can be moved axially along shaft 4. Sliding wall 6 is attached to cover plate 22 by means of fasteners 53 to prevent axial or rotational movement of sliding vane 6 relative to cover plate 22. Positioner mechanism 201A, via positioner 7A which passes through positioner opening 47A in end plate 50, moves rotor assembly 3 axially along shaft 4 toward sliding wall 6. When rotor assembly 3 is fully extended away from sliding wall 6 sliding vanes 10 are fully extended from slots 11 past hub face 38, as illustrated in FIG. 8, pump 1 is set for maximum pumping capacity.

For lower pumping capacity rotor assembly 3 is moved towards sliding wall 6 by positioner mechanism 201A. When rotor assembly 3 moves towards sliding wall 6 sliding vanes 10 slide into radial slots 11 in hub 5. When this occurs the swept volume of fluid chambers 210*a, b, c,* and *d,* as illustrated in FIG. 4, is decreased and therefore pumping volume is reduced.

In this embodiment eccentric chamber 31 is formed by eccentric sleeve 71 which is located in a cylindrical portion of housing 2. Eccentric sleeve 71 is slideably mounted inside housing 2 to permit motion in an axial direction but rotation relative to housing 2 is not permitted by the mounting means. Face 72 of eccentric sleeve 71 which is pressed against hub face 38 of rotor assembly 3 is moved axially towards sliding wall 6, hub face 38 presses against face 72 and moves eccentric sleeve 71 towards cover plate 22. Tensioning means 73 keep eccentric sleeve 71 in contact with hub face 38 of rotor assembly 3. Sliding vanes 10 ride against inner surface 74 of eccentric sleeve 71.

This embodiment of pump 1 is illustrated and described without reference to support ring 18 or partition 19. It is obvious that this embodiment can also incorporate these features.

The above description illustrates the use of the within invention as a variable displacement vane pump. It is also possible to use the instant invention in place of hydraulic motor 205 with a conventional fluid pumping device.

Figure 9:
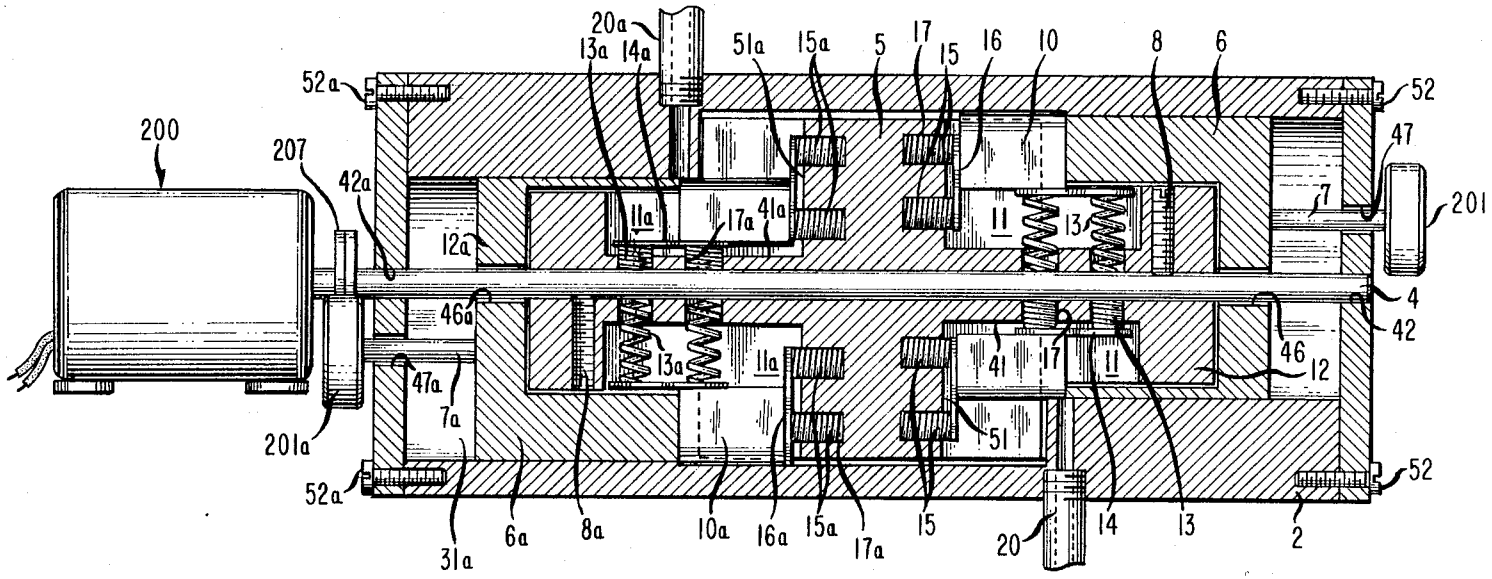
FIG. 9 shows an alternative embodiment of the variable displacement sliding vane pump wherein two sliding vane assemblies are incorporated into one housing.

FIG. 9 shows another alternative embodiment of the variable displacement sliding vane pump which incorporates two pumping chambers. In this embodiment rotor assembly 3 consists of hub 5, rotor 12 and rotor 12*a* each of which incorporates their respective radial slots 11 and 11*a* as well as associated spring recesses 17 and 17*a*, springs 13, 13*a*, 15 and 15*a*, spring tension plates 14, 14*a*, 16 and 16*a* and sliding vanes 10 and 10*a*. In addition, housing 2 contains a second eccentric chamber 31*a* in which a second sliding wall 6*a* is mounted. Sliding wall 6*a* is positioned within eccentric chamber 31*a* by positioner mechanism 201*a*.

From the above description of the structures comprising this invention it is obvious that it offers many improvements over similar devices in prior art. For example, there is disclosed a variable displacement sliding vane pump or hydraulic motor with a wide and continuously variable range of fluid handling capacity. The invention further overcomes the need to incorporate partition walls within the pumping chamber.

It is obvious from the foregoing description of the structure and operation of this invention that this invention can be applied to any type of fluid pumping or hydraulic motor application where variable flow or speed is necessary or desirable. In addition, it is also obvious that more than one pumping chamber can be enclosed in a single pump housing.

It is also obvious that the variability of the pumping capacity of this invention is, for a given pump rotational speed, directly related to the extension or retraction of the sliding vanes into the pumping chamber.

As previously described herein this extension or retraction is accomplished by moving the sliding wall towards or away from the rotor assembly or the rotor assembly towards the sliding wall. This extension and contraction of the sliding vanes can also be accomplished by moving the rotor assembly relative to the sliding wall when the sliding wall is also movable.

In the foregoing description, certain terms have been used for brevity, clarity and understanding, but no unnecessary limitations are to be implied therefrom beyond the requirements of prior art, because such words are used for descriptive purposes herein and are intended to be broadly construed.

Moreover, the embodiments of the improved construction illustrated and described herein are by way of example and the scope of the invention is not limited to the exact details of construction. It is, therefore, understood that, within the scope of the appended claims, the invention may be practiced otherwise than as specifically described herein.

I claim:

1. A variable displacement sliding vane pump/hydraulic motor comprising:

a. a housing which forms an eccentric chamber and a contiguous concentric chamber and contains a fluid inlet port and a fluid outlet port, b. a sliding wall which sits slideably inside said eccentric chamber and which contains a rotor chamber which is concentric with said concentric chamber, c. a rotor assembly comprising a hub which fits rotatably inside said concentric chamber and a rotor which fits rotatably inside said rotor chamber, and which contains a plurality of radial slots, d. a shaft which is attached concentrically to said rotor assembly, e. a plurality of sliding vanes which slideably fit into said radial slots in said rotor assembly, f. tensioning means which impress said sliding vanes outward in radial direction, g. lateral tensioning means which impress said sliding vanes in a direction parallel to the center line of said rotor assembly, h. end plates which enclose the ends of said housing to prevent fluid loss therefrom, and i. a means to slideably position said sliding wall within said eccentric chamber.

2. A device as described in claim 1 comprising:

a. a rotor assembly which is slideably mounted on the shaft to permit axial motion of the rotor assembly on the shafts, b. a means to slideably position said rotor assembly axially along the shaft, c. an eccentric sleeve which is slideably mounted within the housing to permit axial motion but not to permit rotational movement, and d. tensioning means to impress the eccentric sleeve against the hub of the rotor assembly.

3. A device as described in claim 1 wherein:

a. a partition with radial slots fixedly attached to said rotor assembly to form a groove between the partition and the hub of the rotor assembly, and b. a sliding vane support ring which is fixedly attached to the housing in the concentric chamber and is located in the grove adjacent to the partition and which has a cylindrical inner surface which is the same diameter and concentric with the eccentric chamber of the housing.

4. A device as described in claim 3 which contains at least two of each of the following: sliding walls, fluid inlet ports, fluid outlet ports and sliding wall positioning means.

5. A device as described in claim 3 comprising:

a. a rotor assembly which is slideably mounted on the shaft to permit axial motion of the rotor assembly on the shaft, b. a means to slideably position said rotor assembly axially along the shaft, c. an eccentric sleeve which is slideably mounted within the housing to permit axial motion but not permit rotational movement, and d. tensioning means to impress the eccentric sleeve against the hub of the rotor assembly.

6. A device as described in claims 2 or 5 in which the sliding wall is fixedly mounted on one end plate of the pump.

7. A device as described in claim 1 which contains at least two of each of the following: sliding walls, fluid inlet ports, fluid outlet ports and sliding wall positioning means.

8. A device as described in claims 7 or 4 comprising:

a. a rotor assembly which is slideably mounted on the shaft to permit axial motion of the rotor assembly on the shaft, b. a means to slideably position said rotor assembly axially along the shaft, c. an eccentric sleeve which is slideably mounted within the housing to permit axial motion but not to permit rotational movement, and d. tensioning means to impress the eccentric sleeve against the hub of the rotor assembly.

9. A device as described in claim 8 in which the sliding wall is fixedly mounted on one end plate of the pump.

* * * * *